US005755821A

United States Patent [19]

Ngai et al.

[11] Patent Number: 5,755,821

[45] Date of Patent: May 26, 1998

[54] DEVICE FOR PREVENTING THE ERRONEOUS CONNECTION OF SIGNAL LINES TO A COMPUTER NETWORK HUB

[75] Inventors: Henry Ngai; Yuh-Shuan Chang, both of Hsinchu, Taiwan

[73] Assignee: D-Link Corporation, Hsinchu, Taiwan

[21] Appl. No.: 654,263

[22] Filed: May 28, 1996

[51] Int. Cl.[6] ..... H01R 13/44

[52] U.S. Cl. ..... 439/138

[58] Field of Search ..... 434/138, 142, 434/218, 222, 676

[56] References Cited

U.S. PATENT DOCUMENTS 5,362,254 11/1994 Siemon et al. ..... 439/142

*Primary Examiner*—Neil Abrams
*Assistant Examiner*—Barry M.L. Standig
*Attorney, Agent, or Firm*—Bacon & Thomas

[57] ABSTRACT

Either of a pair of adjacent plug holes in a computer network hub is automatically closed by a swinging door plate whenever a connector of a signal line is inserted into the other plug hole to prevent the simultaneous insertion of two connectors into both plug holes.

4 Claims, 3 Drawing Sheets

DEVICE FOR PREVENTING THE ERRONEOUS CONNECTION OF SIGNAL LINES TO A COMPUTER NETWORK HUB

BACKGROUND OF THE INVENTION

The present invention relates to a hub for computer network systems which has a swinging door mounted in between two plug holes thereof to alternatively close the plug holes and prevent the insertion of two connectors into the two plug holes at the same time.

A regular hub is generally equipped with an option switch for the selection of the function MD1 or or the function MD1-X. When in use, only one signal line can be connected to the two plug holes of the hub. If two signal lines are respectively connected to the two plug holes, the hub cannot work normally.

SUMMARY OF THE INVENTION

The present invention has been accomplished to provide a hub which eliminates the aforesaid problem. It is one object of the present invention to provide a hub which has a swinging door mounted in between two plug holes thereof to automatically and alternatively close the plug holes so that only one plug hole is opened for the insertion of the connector of a signal line. It is another object of the present invention to provide a hub which has a swinging door mounted in between two plug holes thereof to alternatively close the plug holes, wherein the swinging door will close the non-selected plug hole upon the insertion of the connector of a signal into the selected plug hole. It is still another object of the present invention to provide a hub which has a swinging door mounted in between two plug holes thereof to alternatively close the plug holes so that the user need not to worry about the possibility of the connection of two signal lines to the two plug holes. It is still another object of the present invention to provide a hub which keeps working normally when the swinging door which is mounted in between two plug holes thereof to alternatively close the plug holes is damaged.

DETAILED DESCRIPTION OF THE PREFERRED EMBODIMENT

Figure 1:
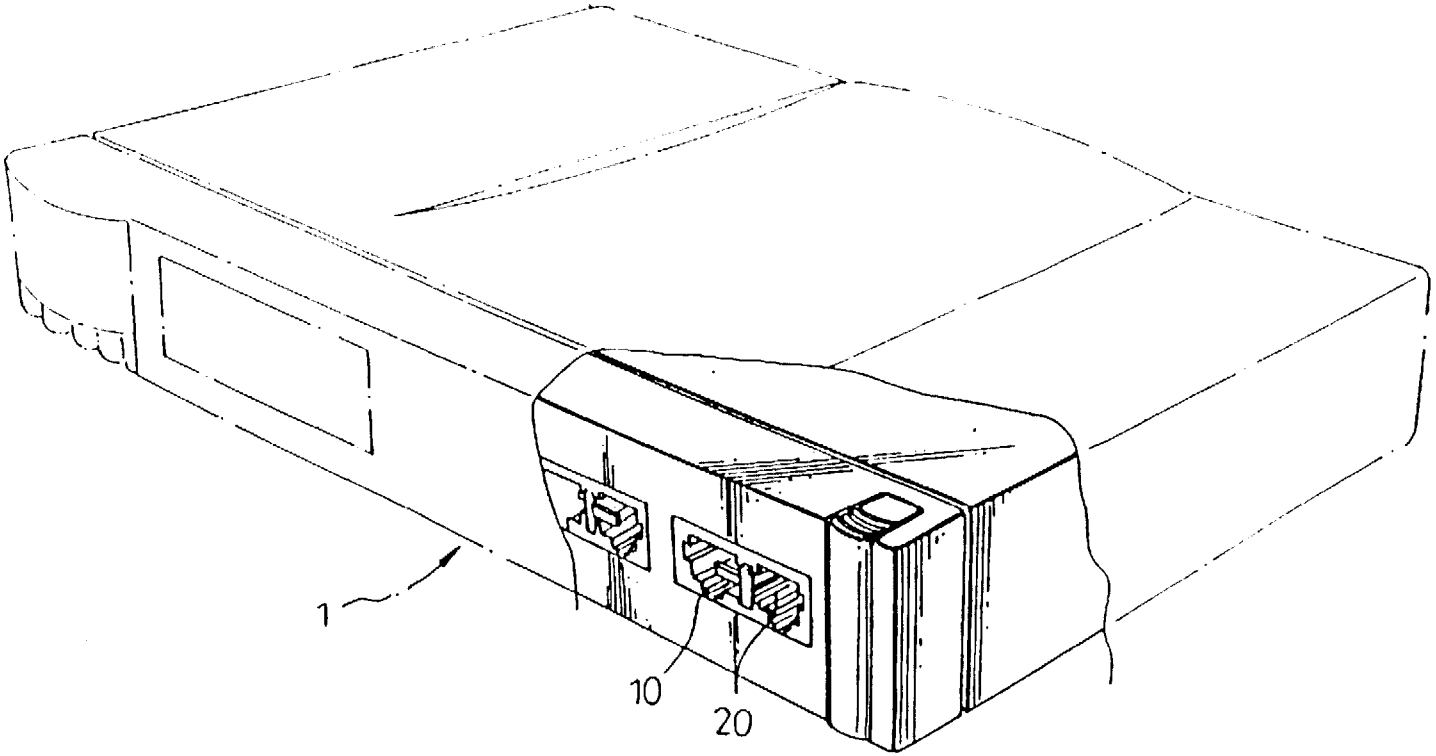
FIG. 1 shows a hub according to the present invention.
Figures 2, 2A:
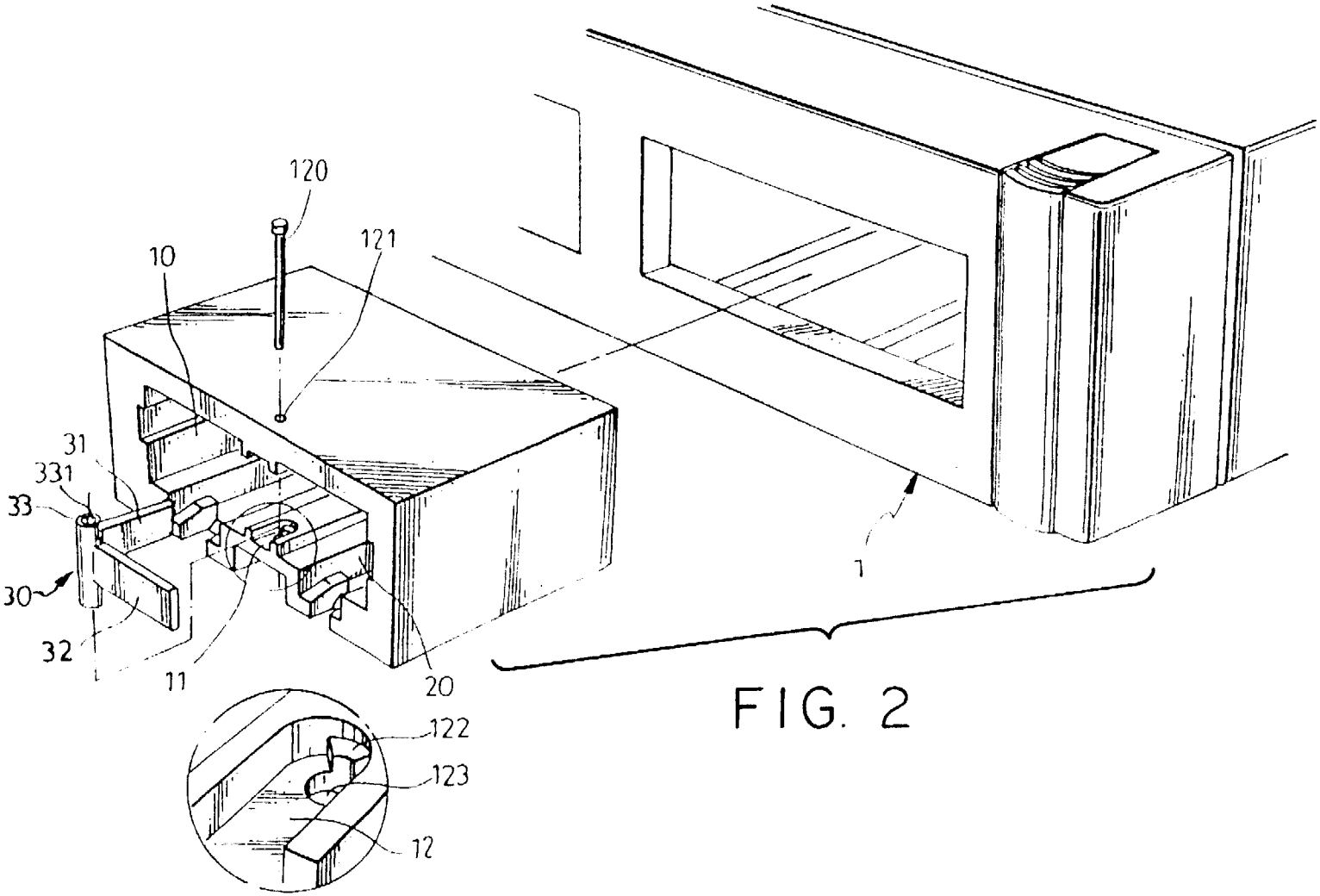
FIG. 2 is an exploded view on an enlarged scale of the hub shown in FIG. 1.
Figure 5:
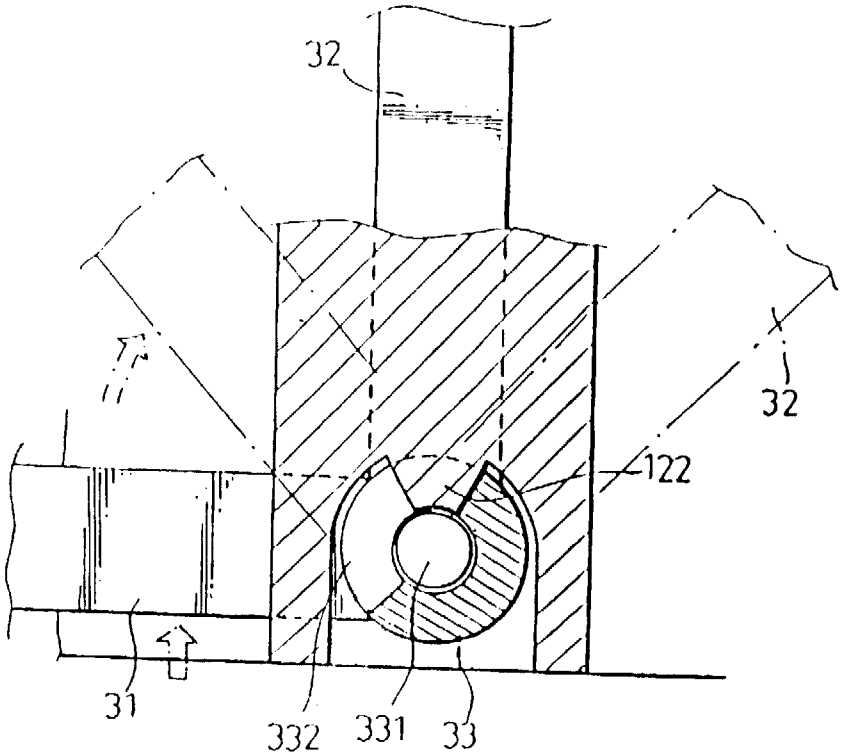
FIG. 5 is a top plan view showing the swinging door turned in the trough according to the present invention.

Referring to FIGS. 1 and 2, the hub, referenced by 1, comprises two plug holes 10, 20 adapted for the connection of the connector of a signal line, enabling the hub 1 to execute the function of MD1 or MD1-X optionally. The plug holes 10, 20 are separated by a space 11. A trough 12 of oval shape is defined in the space 11. The trough 12 comprises a recessed hole 123 and a block 122 connected between the inside wall of the trough 12 and the recessed hole 123. A swinging door 30 is installed in the space 11. The swinging door 30 comprises a vertical shaft 33, a first door plate 31 and a second door plate 32 extending perpendicularly raised from the vertical shaft 33 a right angle to each other. The vertical shaft 33 has a longitudinal center through hole 331. A pivot 120 is inserted through the longitudinal center through hole 331 of the vertical shaft 33 and connected between a hole 121 in the top wall of the hub 1 and a recessed hole 123 of the trough 12. Referring also to FIG. 5, the vertical shaft 33 of the swinging door 30 has a notch 332 at the bottom. The two opposite lateral sides of the notch 332 are spaced from each other at angle to each other 150°. The size of the notch 332 is bigger than that of the block 122. When the swinging door 30 is coupled to the trough 12, the notch 332 receives the block 122. The block 122 has two opposite lateral sides spaced from each other at an angle of 60°. Therefore, when the swinging door 30 is turned about the pivot 120, the block 122 limits the turning angle of the swinging door 30 to within an angle of 90°.

Figure 3:
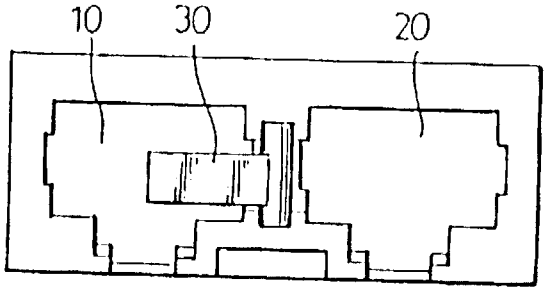
FIG. 3 is a front view of the present invention, showing one door plate moved into the left plug hole.
Figure 4:
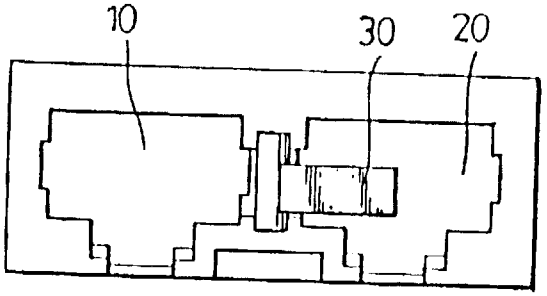
FIG. 4 is another front view of the present invention, showing one door plate moved into the right plug hole.

Referring to FIGS. 3 and 4, and FIG. 2 again, when the swinging door 30 is installed, the bottom end of the vertical shaft 33 is inserted into the recessed hole 123 of the trough 12, and the notch 332 is coupled to the block 122 of the trough 12 to limit the turning angle of the swinging door 30 to within 90°. Therefore, when one door plate 31 (or 32) is moved into alignment with the back side of the plug holes 10, 20, the other door plate 32 (or 31) is automatically moved into the space 11, i.e., only one plug hole 10 or 20 is opened for the insertion of the connector of a signal line. This design eliminates the occurrence of an error connection of the signal line.

Further, because the connection between the swinging door 30 and the trough 12 is a mechanical connection. If the swinging door 30 is damaged, the hub 1 can still work normally. When the connector of a signal line is inserted into one plug hole 10 (or 20), the corresponding door plate 31 (or 32) is turned inwards to the space 11, thereby causing the other door plate 32 (or 31) to be automatically turned outwards to close the other plug hole 20 (or 10).

It is to be understood that the drawings are designed for purposes of illustration only, and are not intended as a definition of the limits and scope of the invention disclosed.

What the invention claimed is:

1. A hub having two plug holes adapted for the optional connection of a connector of a signal line, the improvement comprising a space defined between said two plug holes, a trough formed in said space, and a swinging door mounted in said space for pivotal movement to alternatively close said plug holes, said swinging door comprising a vertical shaft pivotally supported in said trough, two door plates perpendicularly extended from said vertical shaft and spaced from each other at an angle, one of said two door plates being moved out of one of said two plug holes and the other plate thereof being moved out of said space to close the other of said two plug holes upon the insertion of the connector of one signal line into one of said two plug holes.

2. The hub of claim 1 wherein said door plate is turned about a pivot installed in said space in a vertical position between said two plug holes, and the vertical shaft of said swinging door plate has a longitudinal center through hole which receives said pivot.

3. The hub of claim 2, wherein the swinging door has a turning angle, the vertical shaft of said swinging door has a bottom notch coupled to a block inside said trough, said block stopping one side of said bottom notch to limit the turning angle of said swinging door when said swinging door is turned about said pivot.

4. The hub of claim 1 wherein the two door plates of said swinging door are spaced from each other at a right angle.

* * * * *